US011703065B2

(12) United States Patent
Loercher et al.

(10) Patent No.: US 11,703,065 B2
(45) Date of Patent: Jul. 18, 2023

(54) FAN AND INTAKE GRID FOR A FAN

(71) Applicant: ZIEHL-ABEGG SE, Kunzelsau (DE)

(72) Inventors: Frieder Loercher, Braunsbach (DE); Alexander Herold, Hardthausen (DE)

(73) Assignee: ZIEHL-ABEGG SE, Künzelsau (DE)

( * ) Notice: Subject to any disclaimer, the term of this patent is extended or adjusted under 35 U.S.C. 154(b) by 0 days.

(21) Appl. No.: 17/046,451

(22) PCT Filed: Feb. 15, 2019

(86) PCT No.: PCT/DE2019/200013
§ 371 (c)(1),
(2) Date: Oct. 9, 2020

(87) PCT Pub. No.: WO2019/196992
PCT Pub. Date: Oct. 17, 2019

(65) Prior Publication Data

US 2021/0164495 A1 Jun. 3, 2021

(30) Foreign Application Priority Data

Apr. 9, 2018 (DE) ..... 102018205300.6

(51) Int. Cl.
*F04D 29/70* (2006.01)
*F04D 29/54* (2006.01)

(52) U.S. Cl.
CPC ..... *F04D 29/541* (2013.01); *F04D 29/703* (2013.01)

(58) Field of Classification Search
CPC .... F04D 29/541; F04D 29/703; F04D 29/667; F04D 29/4216; F05D 2250/51; F05D 2210/12
See application file for complete search history.

(56) References Cited

U.S. PATENT DOCUMENTS 5,088,886 A * 2/1992 Hopkins ..... F04D 29/667 415/119
7,104,753 B2 9/2006 Eubank et al.
(Continued)

FOREIGN PATENT DOCUMENTS

CN 201246347 Y 5/2009
DE 102015112148 A1 2/2016
(Continued)

*Primary Examiner* — Aaron R Eastman
(74) *Attorney, Agent, or Firm* — FisherBroyles, LLP; Jason P. Mueller

(57) ABSTRACT

Disclosed fans include an impeller and a guide device. The impeller is configured to generate an air flow path having an upstream direction and a downstream direction, and the guide device is positioned in the flow path located on an upstream side of the impeller. The guide device is configured as an intake grid having flat webs having branches and node points, and the webs form a plurality of flow channels configured as grid cells. The webs extend either between two branches or between one branch and a border area and each branch may include three webs that meet. In one configuration, flow channels include channels having a honeycomb cross section. In other example, flow channels may have a rectangular, pentagonal, and/or hexagonal shape. The fan further includes an inlet nozzle having an inlet area, and the guide device is located upstream from the inlet area of the inlet nozzle.

18 Claims, 13 Drawing Sheets

(56) References Cited

U.S. PATENT DOCUMENTS

Figure 1:
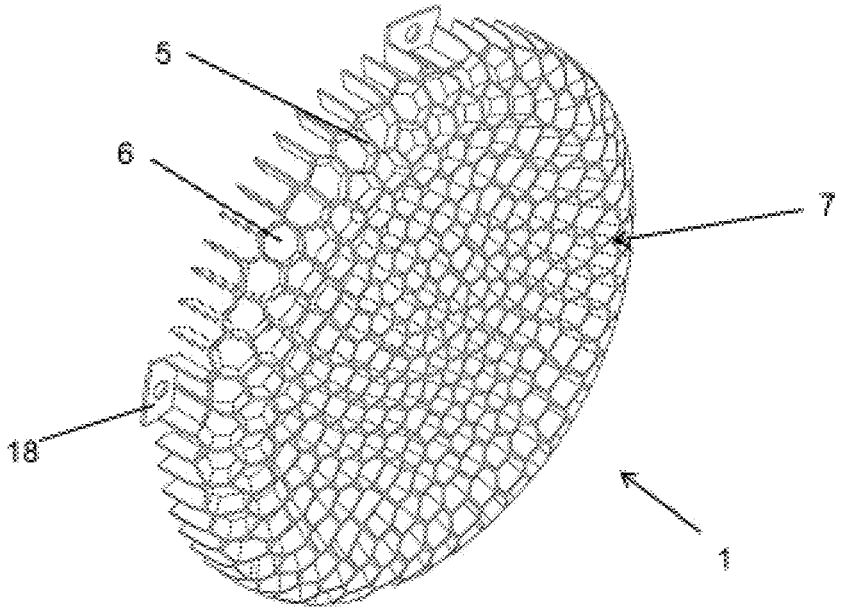

| | | | | |
|---|---|---|---|---|
| 2005/0263199 | A1* | 12/2005 | Meheen | F15D 1/0005 138/44 |
| 2011/0150632 | A1* | 6/2011 | Heli | F04D 29/646 415/121.2 |
| 2015/0104294 | A1* | 4/2015 | Hustvedt | F04D 29/663 415/119 |
| 2016/0097402 | A1* | 4/2016 | Yamagata | F04D 29/703 417/423.7 |
| 2017/0241443 | A1* | 8/2017 | Takashima | F04D 17/08 |
| 2018/0058459 | A1* | 3/2018 | Haaf | F04D 27/001 |
| 2018/0135874 | A1* | 5/2018 | Chang | F04D 29/703 |
| 2018/0156240 | A1* | 6/2018 | Muller | F04D 29/44 |
| 2018/0238352 | A1* | 8/2018 | Guo | F04D 25/0613 |
| 2018/0347594 | A1* | 12/2018 | Arenella | F04D 29/703 |
| 2019/0085851 | A1* | 3/2019 | Hakozaki | F04D 19/007 |
| 2020/0096003 | A1* | 3/2020 | Tsorng | F04D 29/403 |
| 2020/0116165 | A1* | 4/2020 | Loercher | F04D 29/4213 |
| 2021/0262385 | A1* | 8/2021 | Kalevi Makela | F02C 7/052 |
| 2021/0270291 | A1* | 9/2021 | Ichihashi | F04D 25/086 |

FOREIGN PATENT DOCUMENTS

| | | | |
|---|---|---|---|
| DE | 102017209291 | A1 | 12/2018 |
| EP | 3093497 | A2 | 11/2016 |
| JP | 2016035261 | A | 3/2016 |
| RU | 2431062 | C1 | 10/2011 |
| WO | 03054395 | A1 | 7/2003 |
| WO | 2008001032 | A1 | 1/2008 |
| WO | 2015124237 | A1 | 8/2015 |
| WO | 2016071014 | A1 | 5/2016 |
| WO | 2016116871 | A1 | 7/2016 |
| WO | 2017041967 | A1 | 3/2017 |
| WO | 2017089671 | A1 | 6/2017 |

* cited by examiner

FAN AND INTAKE GRID FOR A FAN

This application is a national stage entry under 35 U.S.C. 371 of PCT Patent Application No. PCT/DE2019/200013, filed Feb. 15, 2019, which claims priority to German Patent Application No. 10 2018 205 300.6, filed Apr. 9, 2018, the entire contents of each of which is incorporated herein by reference.

This disclosure relates to a fan (axial fan, radial fan or diagonal fan) having an impeller and a guide device in the flow path upstream from the impeller, upstream from the inlet area of an inlet nozzle, wherein the guide device is configured as an intake grid having flat webs, and wherein the webs form a plurality of flow channels resembling grid cells. In addition, this disclosure relates to an example guide device, configured in the sense of an intake grid having flat webs.

A generic fan having a guide device on the intake side is known from WO 03/05439.5 A1, for example. The guide device provided there serves primarily to smooth out the flow, and to reduce the noise. The known guide device produces a pre-swirl in the direction of rotation of the impeller. It is important here that acoustic improvements are generally associated with a reduction in air performance and efficiency. The guide device provided there is also very expensive to manufacture.

So-called guide wheels that are used to increase efficiency and/or air performance are also known from practice. However, these guide wheels result in acoustic disadvantages and have a complex design as well as being complicated to install in the respective fan products. They are usually installed upstream from fan impellers in a cylindrical installation space with approximately the same diameter as the fan impeller, and therefore they do not have a significantly larger flow-through area. Therefore, the air flow rates in the area of these guide wheels are relatively high, and give rise to undesirable acoustic effects.

This disclosure addresses the following technical problem.

Fans often generate more noise in response to perturbed incoming flow. In many fan applications, for example, in controlled residential ventilation (CRY), perturbed inflow conditions necessarily arise from the usual demands for a compact design. The resulting noise, Which often has major tonal components, is usually low-frequency noise. Noise abatement measures for this low-frequency noise are desirable in ventilation equipment, for example.

It is also already known that the noise associated with perturbed incoming flow can be reduced significantly by using so-called flow rectifiers. However, such flow rectifiers cause a substantial pressure drop that is not insignificant, and they also require a large installation space. Therefore, the object of this disclosure is to design and improve upon such a fan, so that the noise associated with a perturbed flow is reduced. The fan should be compact and should cause only an extremely minor pressure drop. Furthermore, an inlet guide device, which may be an intake grid and/or a guide baffle is to be provided, such that it meets the requirements defined above and can be manufactured by injection molding of plastics with economical tooling. It should have dimensional stability and should advantageously be able to take over the function of a touchproof grid on the intake side.

The object defined above is achieved with respect to an fan by alternative combinations of features according to the features of the independent claims 1, 2 and 3. With respect to the intake grid, the object defined above is achieved by the features of claim 12, which is based on the claims relating to the fan.

In the context of a first variant according to claim 1, the webs extend mainly between two branches or between one branch each into a border area. An example embodiment includes three webs for each branch. With these features, flow channels resembling grid cells may be provided, these flow cells being suitable for reducing noise when there is perturbed flow.

Independent claim 2 achieves the object defined above by the fact that the flow channels have a honeycomb cross section. This design also yields a great stability.

The other independent claim 3 relates to another alternative, according to which the intake grid has a cage-type contour, wherein this embodiment is based on the outer and/or inner enveloping surface(s) of the intake grid.

The same thing is also true of the embodiment of the intake grid itself, which is defined in the other independent claim 12 with reference back to the claims relating to the fan.

The independent claims are based on the fundamental idea of providing an intake grid or inflow grid upstream from the inlet nozzle of a fan, in order to reduce the noise generated during perturbed flow in operation of the fan. The intake grid is defined by flat webs, such that the webs are arranged in relation to one another, so as to form flow channels resembling grid cells. Due to the skillful combination of webs forming branches and node points, it is possible to achieve advantageous geometric shapes, for example, so that the flow channels have a honeycomb cross section. The term "honeycomb" is to be understood in the broadest sense, so that it also includes polygons, such as grid cells with cross sections having 4, 5 or 6 corners or a cross section with even more corners.

According to the aforementioned flow channels resembling grid cells, it is also advantageous that the intake grid has a cage-type contour, such that the contour may refer to either the outer or inner enveloping surface of the intake grid.

An intake grid of the type mentioned above fulfills the requirement of radial intake flow in the area near the nozzle plate. These flow channels have an advantageous effect of minimizing pressure losses. The cage-type outer contour is also advantageous for easy mold release in the context of injection molding technology used with plastic parts. Furthermore, compact grids having the respective properties can also be manufactured in this way.

The cage-type outer contour is advantageous if it is continuous and curved. The grid webs should be configured to be as thin as possible, for example, with a web thickness in the range of 0.25 mm to 1 mm. In the flow-through direction, they should be at least 5 mm deep (hence the term "flat web" used in the claims).

It is additionally advantageous that the grid webs form an unstructured grid, in which honeycomb grid cells are combined with one another. As already explained above, the grid cells may be polygonal and may be combined with one another. This makes it possible to achieve minimal obstruction by the grid webs, for example, when a certain maximum grid width is necessary because of the required noise reduction or taking into account touchproof aspects, resulting in a little loss of pressure and efficiency.

The intake grid also advantageously extends over the entire area up to the imaginary extension of the axis of the fan, i.e., it does not have a relatively large opening in the inner area or has none at all. Such a center opening is not necessary thanks to the teaching of this disclosure. In fact, it should be avoided entirely if the intake grid also fulfils a touchproof function. In addition, it has been found that a center opening would not be consistent with the goals of noise abatement and stability of the grid.

In any case, the design of the intake grid is advantageous, not only with respect to the flow channels that resemble grid cells, but also with respect to the continuous curved outer contour. Unstructured grids can be produced by using rectangular, pentagonal or hexagonal honeycomb elements, thereby making it possible to produce variable grid widths over the entire intake grid as needed.

The intake grid is intended for use in an axial fan, a radial fan or a diagonal fan and is configured according to the preceding description.

Figure 1A:
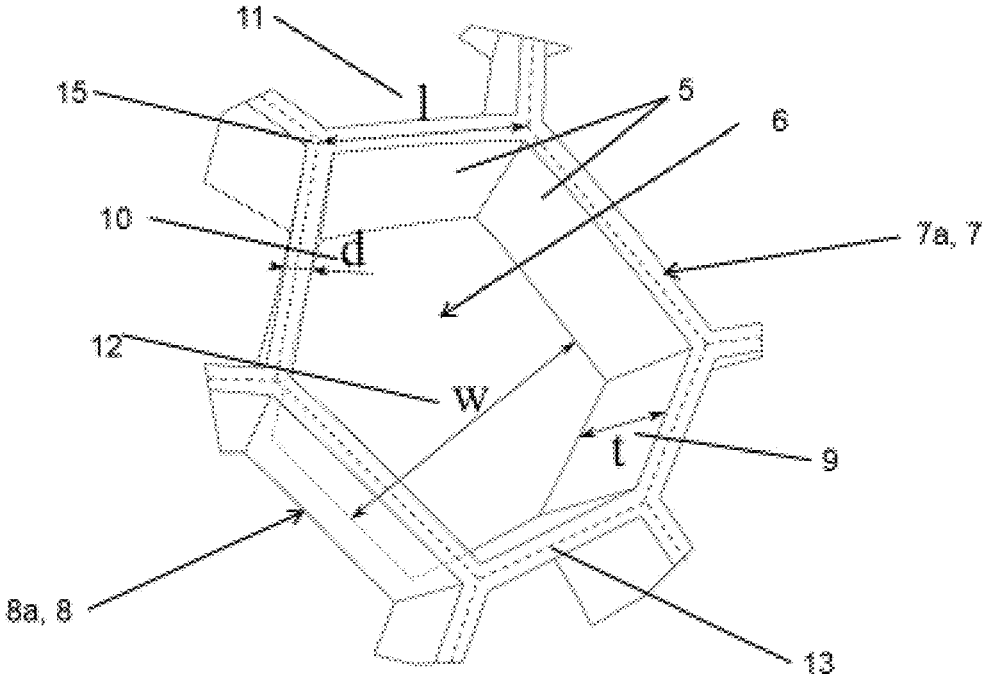
Figure 2:
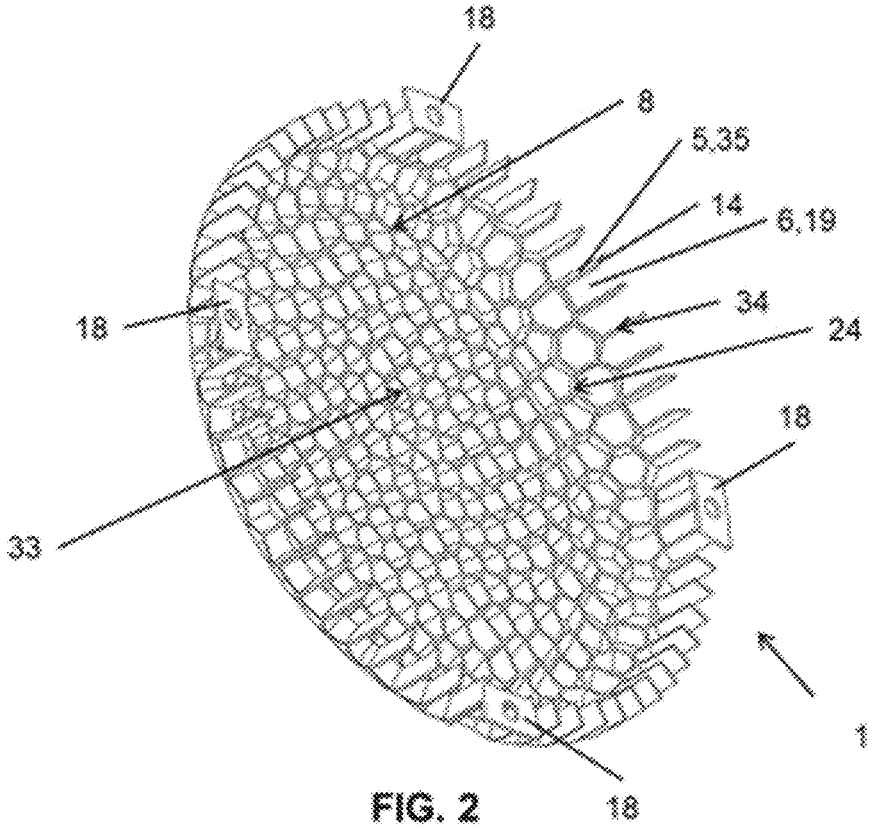
Figure 3:
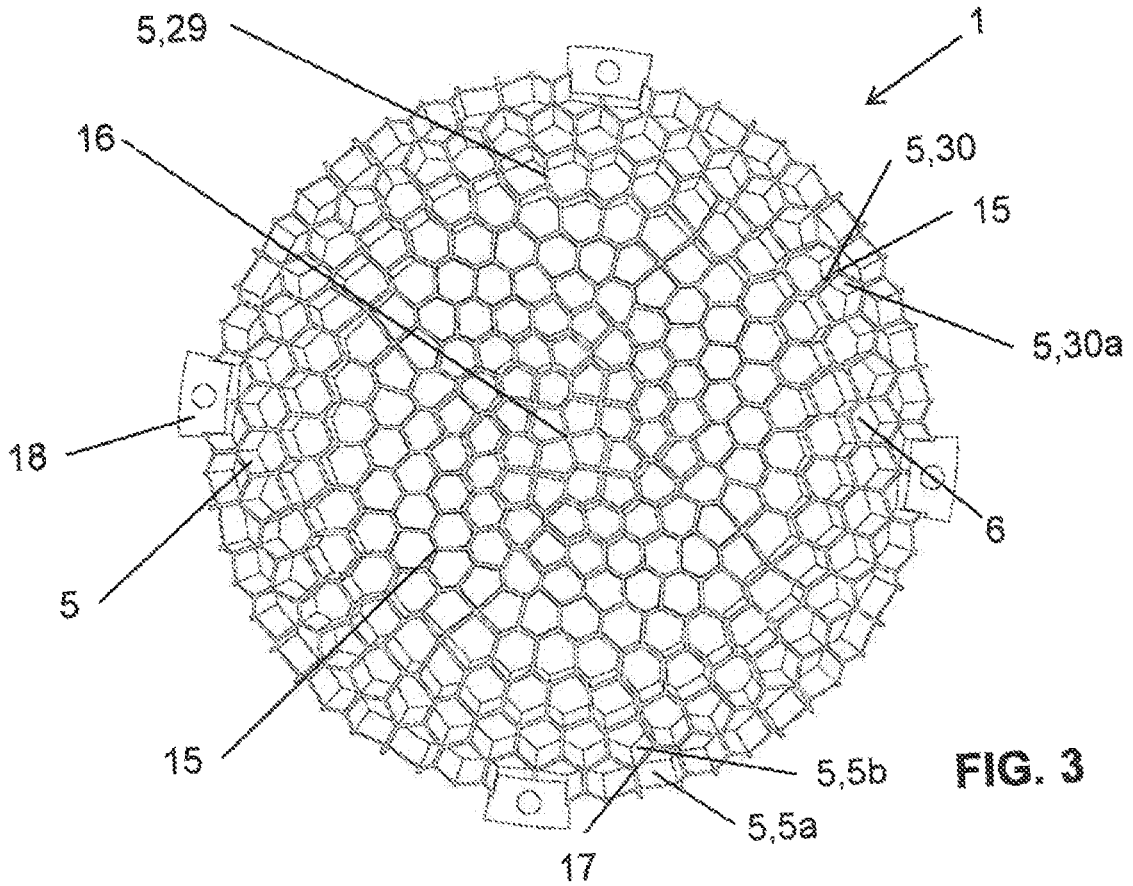
Figure 4:
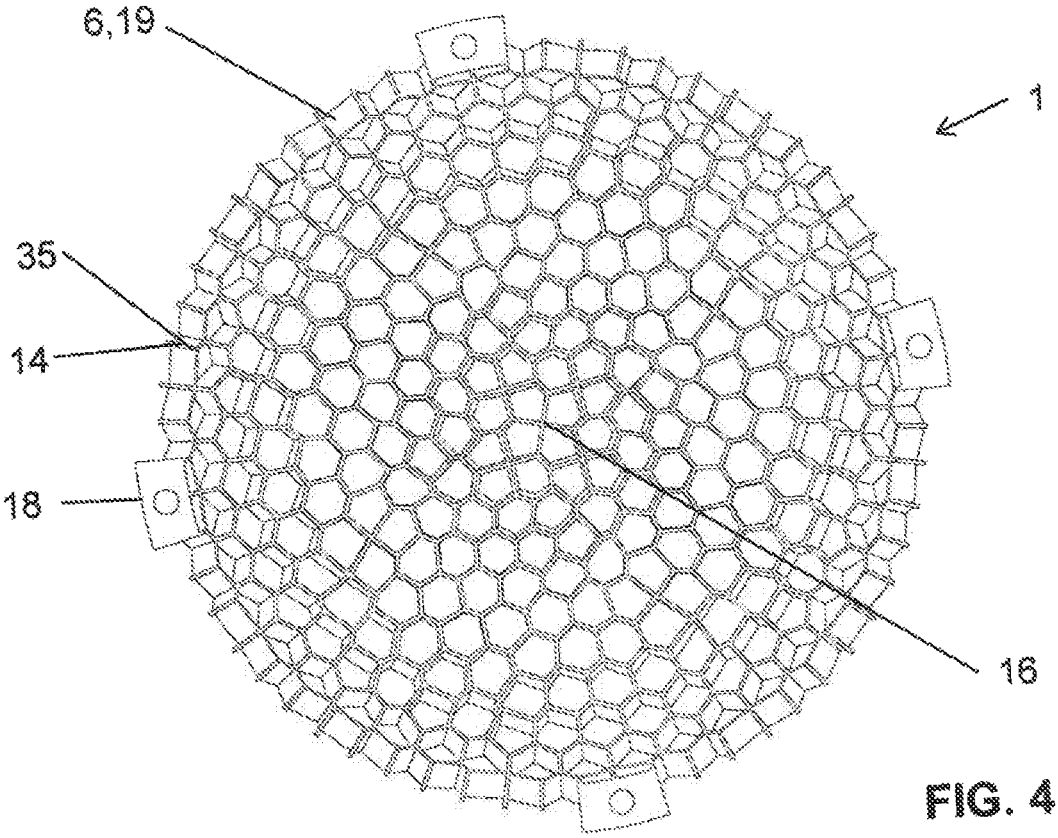
Figure 5:
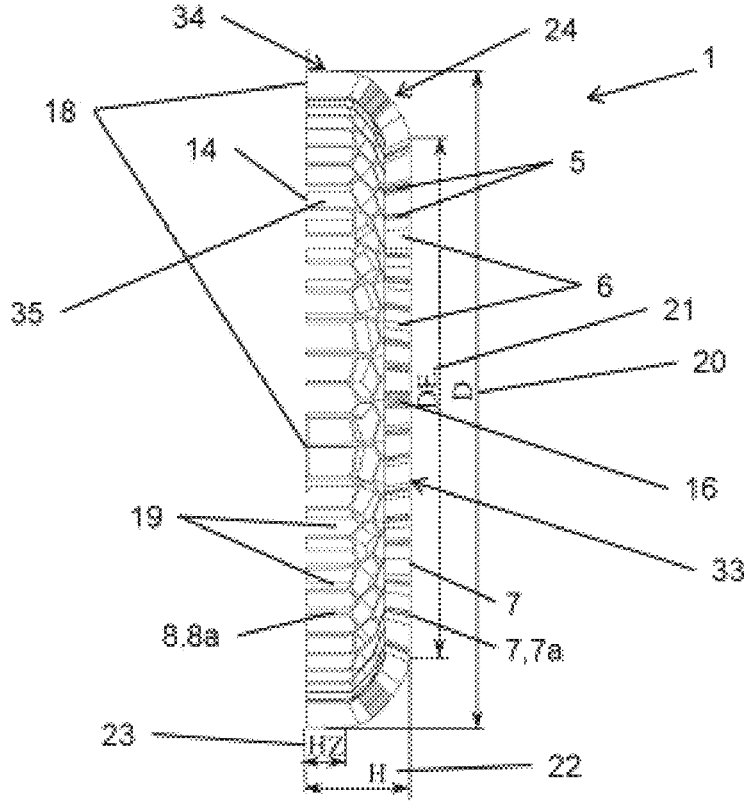
Figure 6:
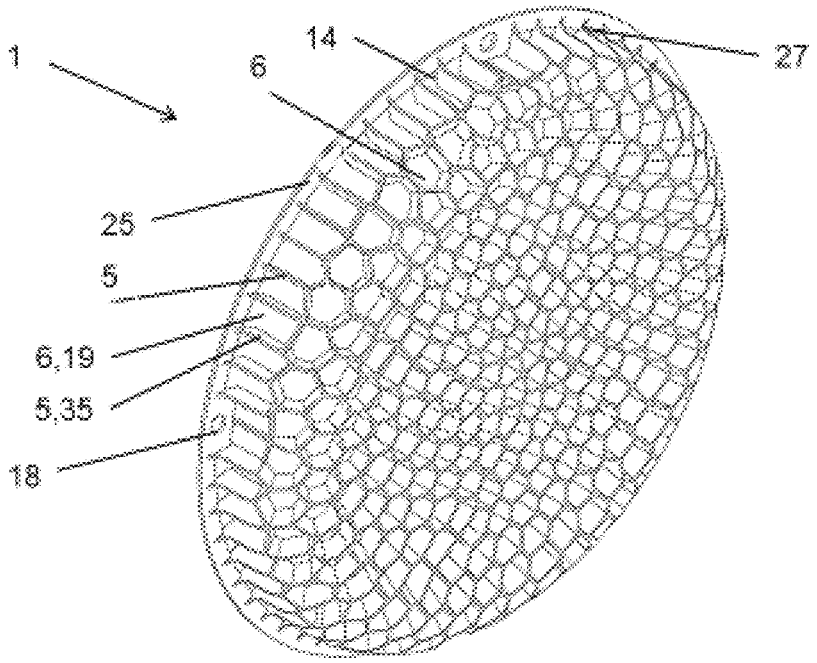
Figure 7:
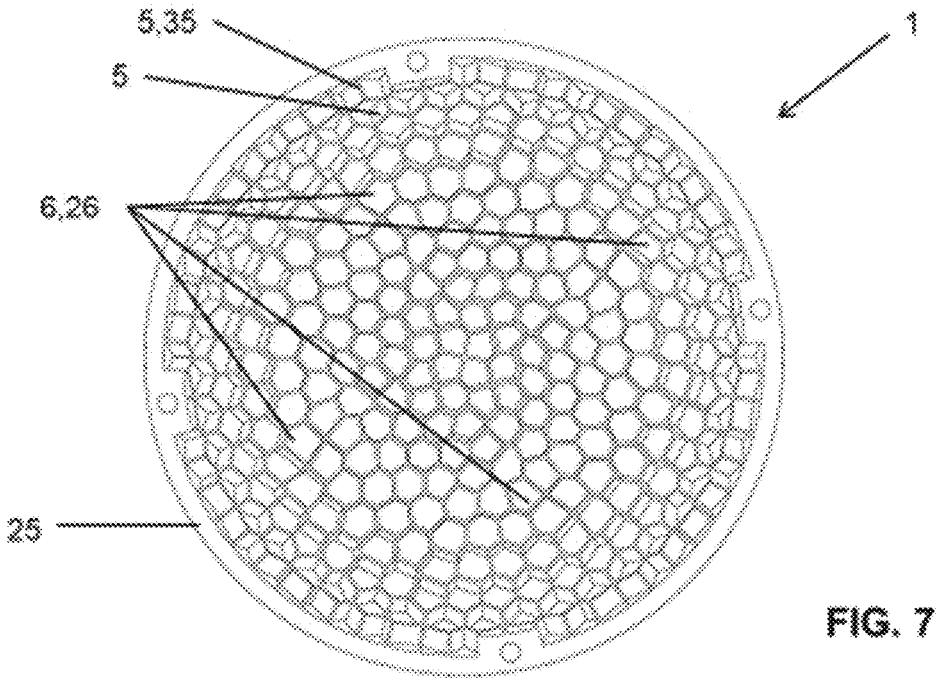
Figure 8:
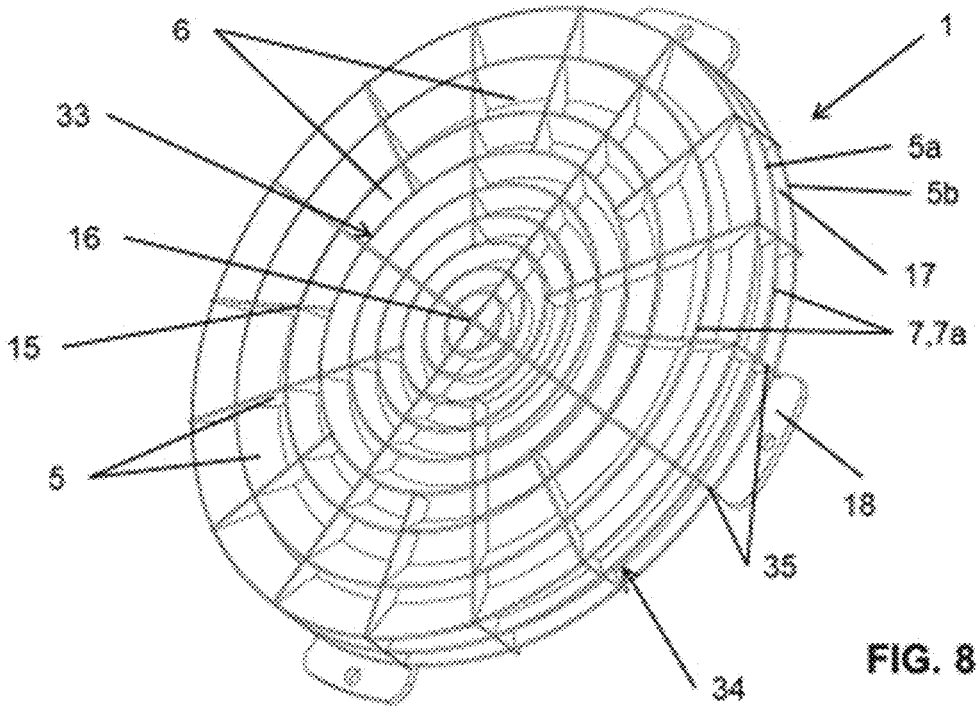
Figure 9:
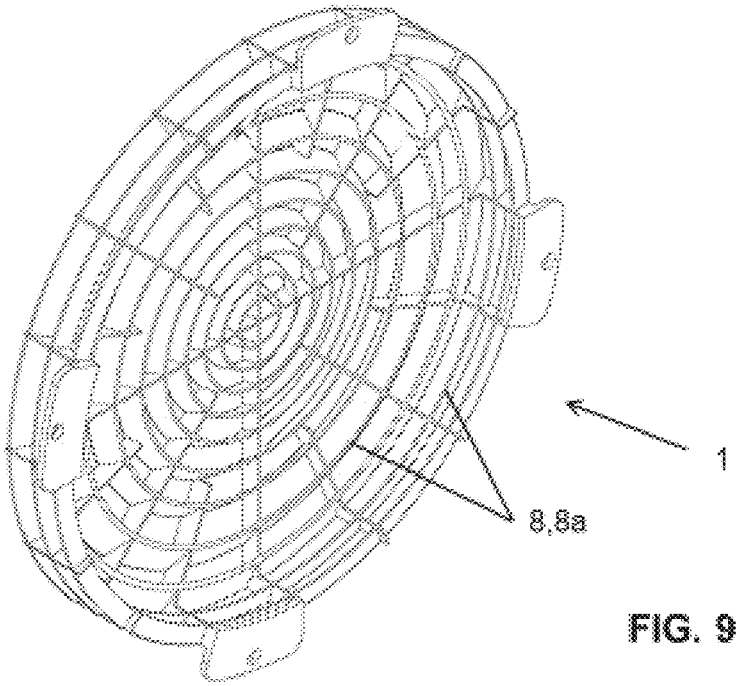
Figure 10:
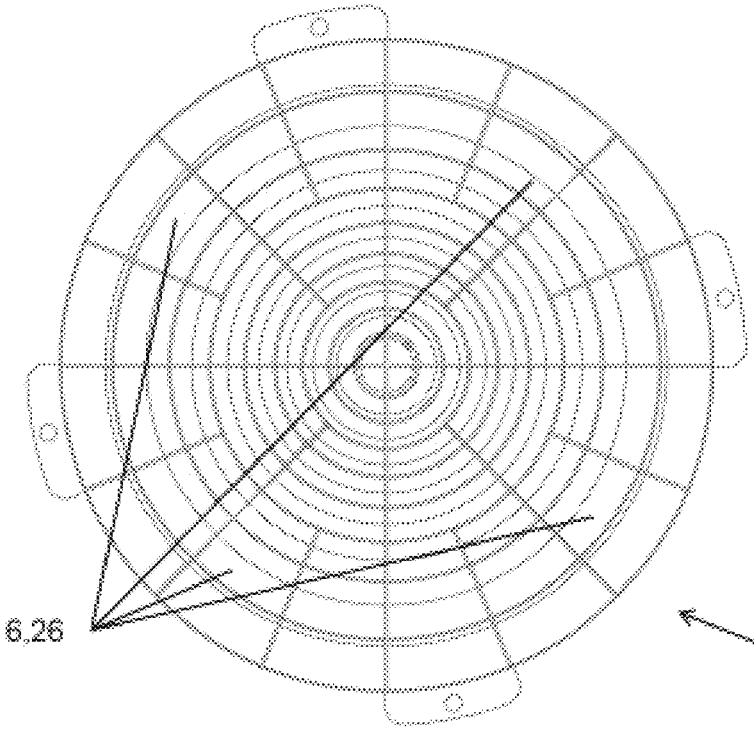
Figure 11:
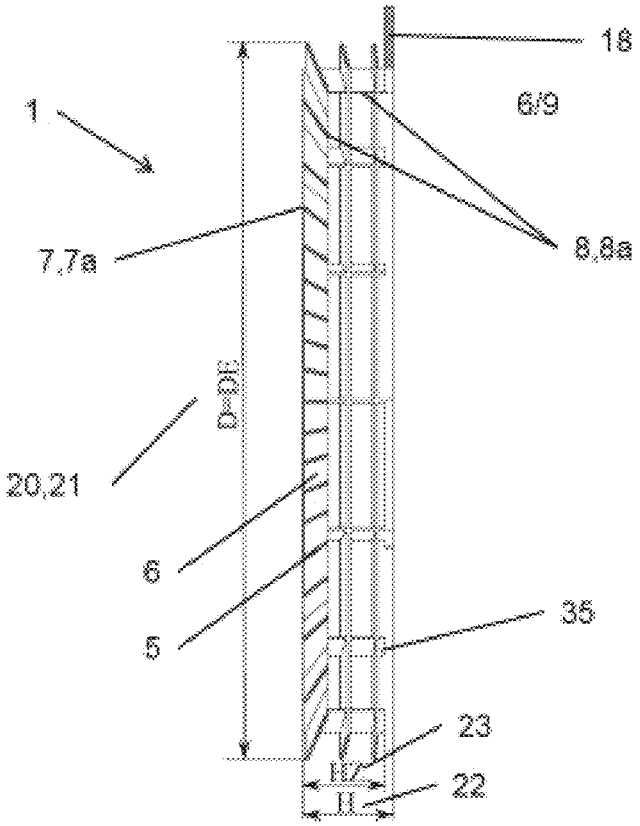
Figure 12:
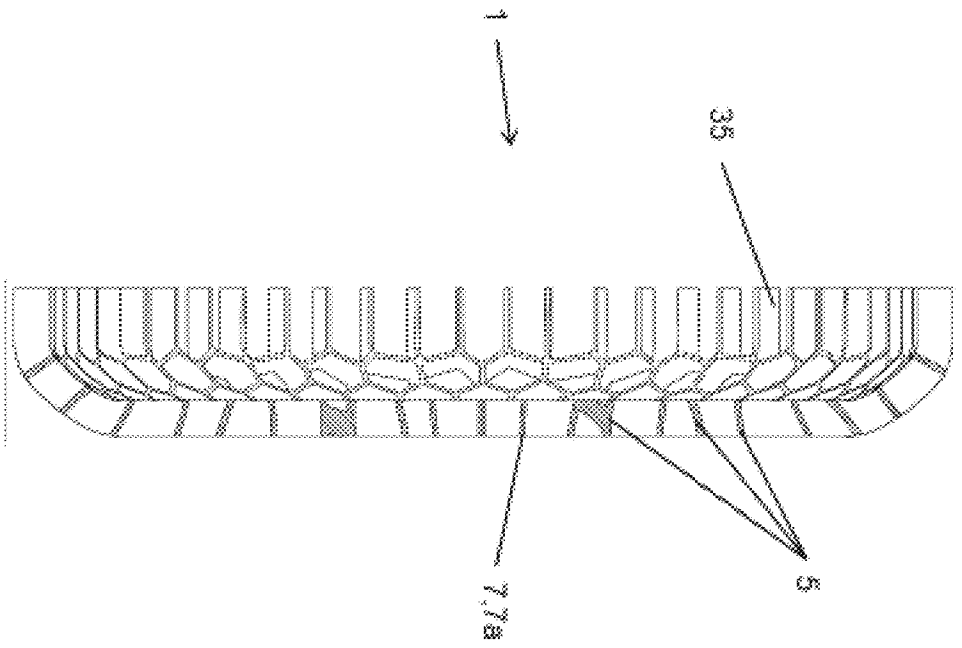
Figure 13:
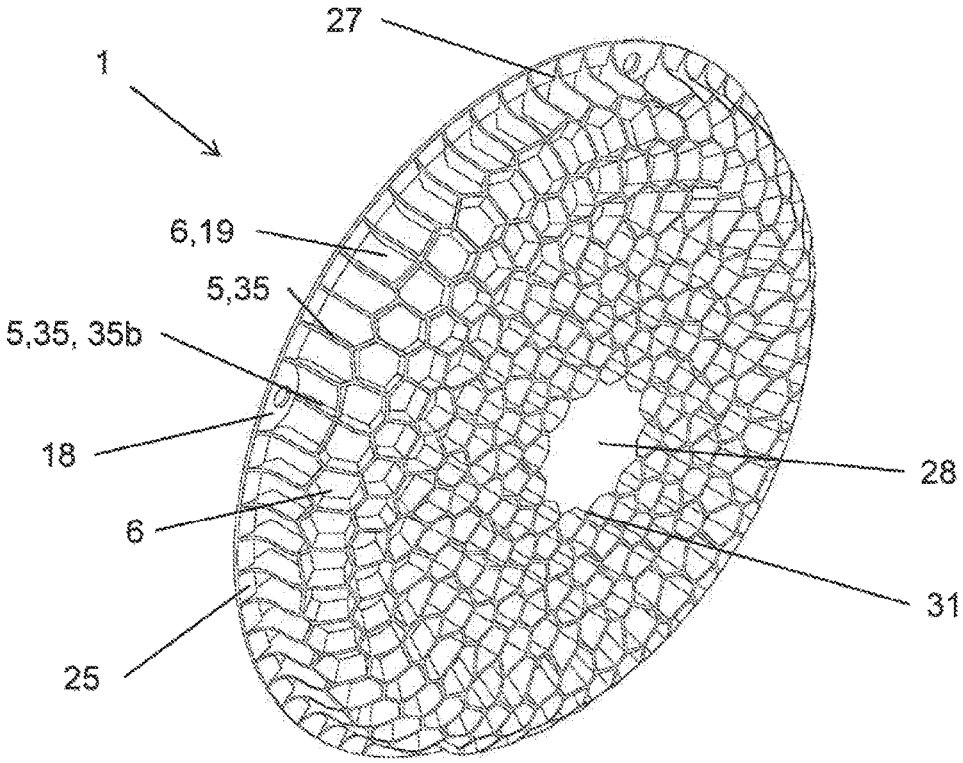
Figure 14:
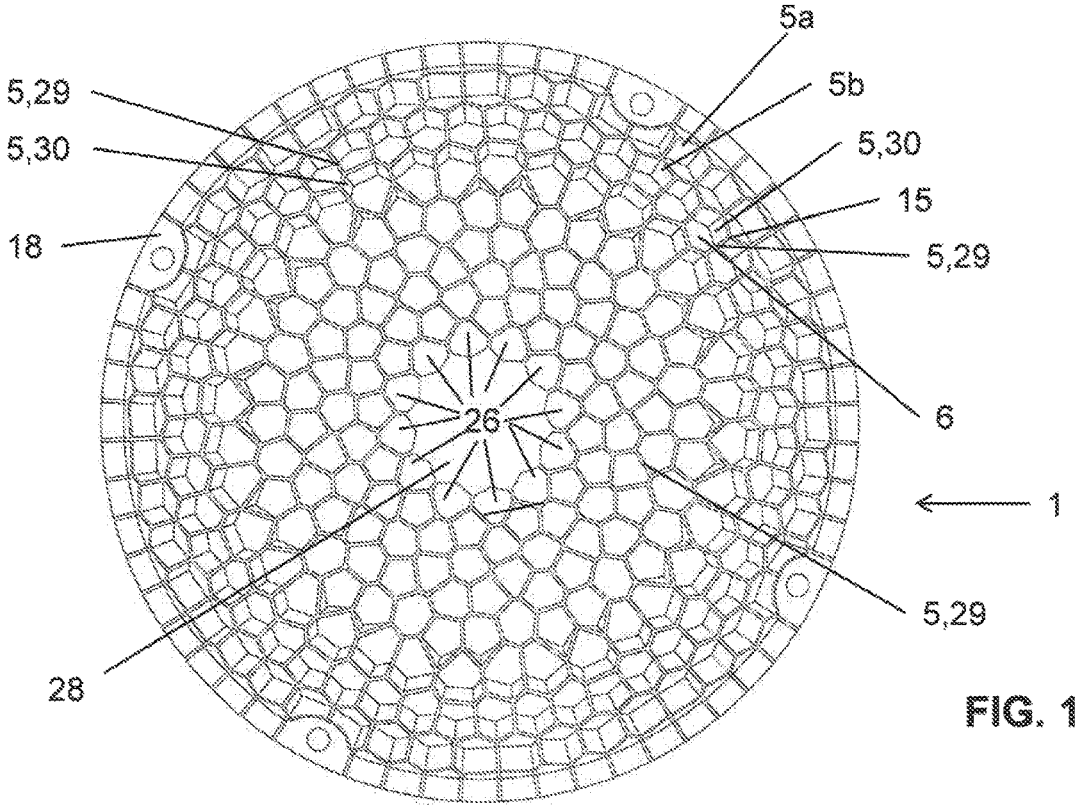
Figure 15:
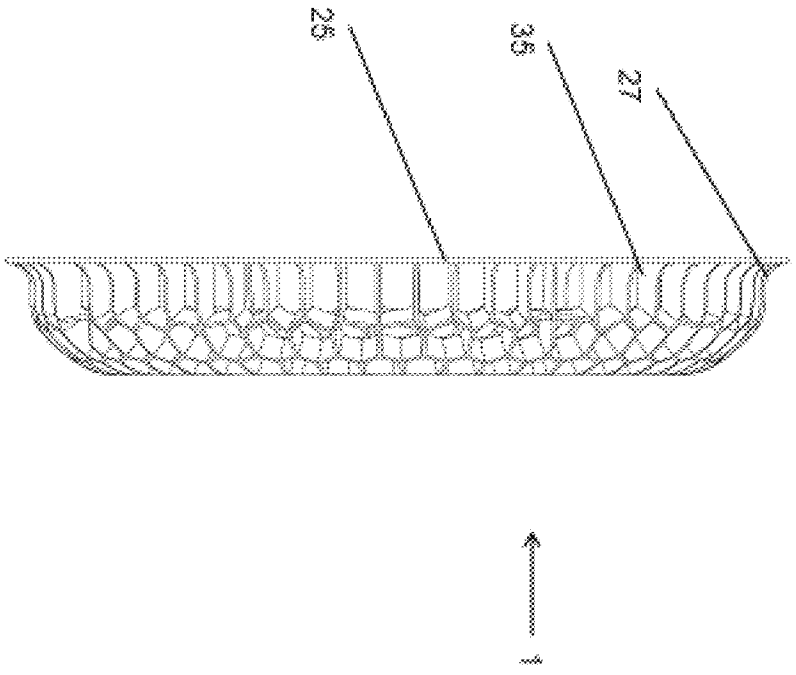
Figure 16:
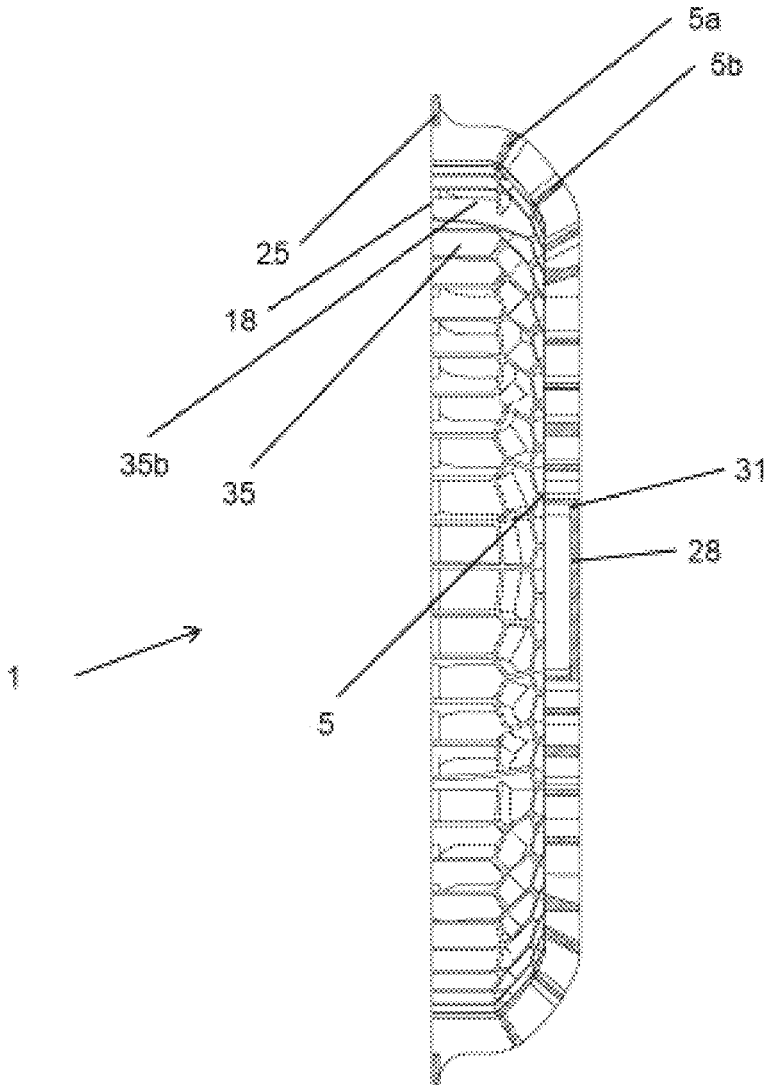
Figure 17:
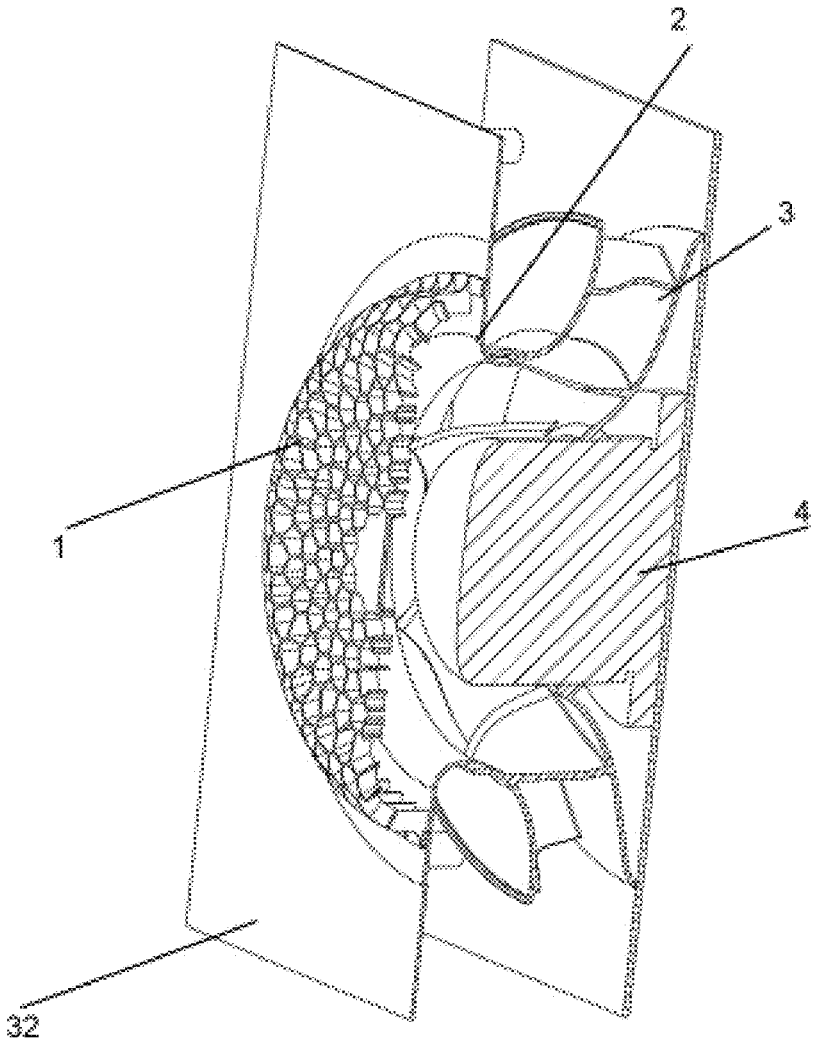

There are now various possibilities for advantageously designing and improving upon the teaching of this disclosure. Reference should be made first to the claims that refer back to claim 1 and, second, to the following discussion of embodiments of an intake and with reference to the drawings. Example embodiments and improvements on the teaching are also described in conjunction with the discussion of specific examples with reference to the drawings. The drawings show:

FIG. 1 a perspective view of one embodiment of an intake grid, as seen from the intake side, FIG. 1*a* a perspective view of a schematic detail of a cell constructed of webs according to FIG. 1, identifying the example dimensions of the webs and cells, FIG. 2 a perspective view of the intake grid from FIG. 1, as seen from the outflow side, FIG. 3 an axial top view of the intake grid from FIGS. 1 and 2, as seen from the inflow side, FIG. 4 an axial top view of the intake grid from FIGS. 1 to 3, as seen from the outflow side, FIG. 5 a side view and a sectional view of the intake grid according to FIGS. 1 to 4 in a plane through the axis, identifying the example dimensions of the intake grid, FIG. 6 a perspective view of another embodiment of an intake grid, as seen from the inflow side, FIG. 7 an axial top view of the intake grid from FIG. 6, as seen from the outflow side, FIG. 8 a perspective view of another embodiment of an intake grid, as seen from the inflow side, FIG. 9 a perspective view of the intake grid from FIG. 8, as seen from the outflow side, FIG. 10 an axial top view of the intake grid from FIGS. 8 and 9, as seen from the inflow side, FIG. 11 a side view and a sectional view of the intake grid according to FIGS. 8 to 10 in a plane through the axis, identifying the example dimensions of the intake grid, FIG. 12 a side view and a sectional view of an intake grid having curved webs, in a plane through the axis, FIG. 13 a perspective view of another embodiment of an intake grid having a central closed injection area, as seen from the inflow side, FIG. 14 an axial top view of the intake grid from FIG. 13, as seen from the inflow side, FIG. 15 a side view of the intake grid according to FIGS. 13 and 14, FIG. 16 a side view and a sectional view of the intake grid according to FIGS. 13 to 15, in a plane through the axis, FIG. 17 a perspective schematic diagram of a fan having a motor, an impeller, an inlet nozzle, a nozzle plate and the intake grid according to FIGS. 13 to 16, as seen from the inflow side, and a sectional view in a plane through the axis.

FIG. 1 shows one embodiment of an intake grid 1 in a perspective view from the front, i.e., as seen from the inflow side. As in the diagram in FIG. 17, the intake grid 1 is advantageously mounted upstream from the inlet nozzle 2 of a fan, so that its axis corresponds approximately to the axis of rotation of the fan. During operation of the fan, air flows first through the intake grid 1 into the inflow nozzle 2 before undergoing a total increase in pressure in flowing through an impeller of fan, which is driven by a motor 4. The intake grid 1 smooths out the incoming air flow, thereby reducing the noise generated in the impeller.

The intake grid 1 consists of a plurality of webs 5, which define grid cells 6. Air flows through the grid cells 6 during operation of the fan, i.e., the cells form flow channels. The speed of the incoming air flow is lower in an area upstream from an inlet nozzle 2 than in the interior of an inlet nozzle 2, because the flow-through area for the air mass flow rate conveyed by the fan is greater in an area upstream from an inlet nozzle 2 than in the inlet nozzle 2. The intake grid 1 is used in such an area of low flow rates, i.e., the flow-through rate with the intake grid 1 is lower than the flow-through rate in the inlet nozzle 2. This minimizes flow losses and the noise generated at the intake grid 1.

However, since the inflow in an area upstream from an inlet nozzle 2 is not smooth, i.e., is not primarily parallel to the axis, it is also a great advantage not to design the contour of the intake grid 1 to be completely smooth. The contour may also be described by the outer enveloping surface 7 and/or the inner enveloping surface 8 (FIG. 2) of the intake grid 1. These enveloping surfaces 7, 8 are defined by the totality of the end faces 7*a* and 8*a* of the webs 5 on the inlet and/or outlet ends (see FIG. 1*a*), respectively, supplemented by imaginary continuous completion of surfaces or curved and continuous completion of surfaces in the area of flow channels 6.

FIG. 1*a* shows a detailed, enlarged diagram of an area of the intake grid 1 from FIG. 1. The webs 5 have a significant depth t (9), as seen in the direction of through-flow, advantageously approximately 6-20 mm. For this reason, the webs 5 are also referred to as "flat" webs. A grid cell 6 includes a cell width w (12), for example, defined by the radius of the largest inner sphere of the cell 6. A small grid width w (12) is advantageous in order to achieve good acoustic values, for example, a value w (12) of no more than two to three times the web depth t (12) for most of the cells 6 of an intake grid 1. The intake grid 1 in the embodiment according to FIG. 1 is also a touchproof device, which must conform to requirements according to standards and regulations with regard to the cell width w (12) as a function of the shape of the cell and the distance of the cell 6 from a rotating part of the fan. Therefore, the cell width w (12) also has an upper size limit.

For the loss of pressure and efficiency to be low, it is advantageous for the obstruction of the flow-through area by the grid webs 5 to be as low as possible. This can be achieved by having thin webs (web thickness d (10) that are advantageously mostly ≤2 mm [≤1 mm]) and/or by minimizing the total web length (sum of all web lengths l (11) of an intake grid (1). The web lengths 1 are determined on the basis of the neutral fibers 13, advantageously on the outer or inner enveloping surface 7 and/or 8). An "unstructured" grid design with honeycomb cells 6 as in the embodiment may be very advantageous for the required total web length under the conditions described for the maximum grid width w (12).

FIG. 2 shows a perspective view of the intake grid 1 according to FIG. 1, as seen from the outflow side. The intake grid 1 has mounting areas 18 on the outer area, which serve to attach the intake grid 1 to the inlet nozzle 2 or the nozzle plate 32 (FIG. 17). Various options may be considered for the design of the mounting areas 18. Possible fastenings include screws, rivets, snap-fit hooks, bayonet closures, adhesive bonding, interlocking, hook-and-loop fastenings or others. In this embodiment, a screw hole is provided in each of four mounting areas 18.

The cage-type contour of the inner enveloping surface 8 of the intake grid 1 can be seen well in the view according to FIG. 2. This contour continues for a short distance on the outer circumference, advantageously more than 10 mm or more than 8% of the outside diameter D (20) (FIG. 5), approximately parallel to the imaginary center axis, approximately on a cylinder surface (cylinder surface-type area 34). This cylinder surface-type area 34 contains the cells 19 of the outer row, two neighboring cells of which are separated from one another by a web 35 of the outer row. The cells 19 of the outer row have a very elongated shape. In order to ensure that they are touchproof and to achieve the acoustic improvements, the cell widths w (inner sphere radii, determined in the cells 19 of the outer row essentially by the distance between two neighboring webs 35 of the outer row) of these cells tend to be lower in comparison with the inner sphere radii of the other cells 6. In an area near the axis, the contour runs flat or planar, approximately orthogonal to the axis (flat area 33). In this embodiment, the transition from the flat area 33 to the cylinder surface-type area 34 takes place over a short transitional area 24, which has a curvature. In this embodiment, the outer enveloping surface 7 and the inner enveloping surface 8 are approximately parallel. The areas 33, 34, 24 can be classified on the basis of the outer and/or inner enveloping surface(s) 7 and/or 8, respectively.

FIG. 3 shows the intake grid 1 according to FIGS. 1 and 2 in an axial top view from the front (as seen from the inflow side). Such an intake grid 1 is advantageously manufactured by injection molding of plastics. It is additionally advantageous to also select the line of sight from FIG. 3 as the direction of mold release for an injection mold to minimize the complexity of the mold. Then one mold part is moving toward the observer in relation to the intake grid 1, this part advantageously being the nozzle side of the mold, and another mold part is moving away from the observer. To simplify manufacturing, the injection mold advantageously has no other slide valves.

The mounting areas 18 are configured together with the grid webs 5, so that they can be released from an injection mold in a sliding direction parallel to the axis (corresponding to the line of sight in this diagram) without any undercuts. It can be seen that some of the grid webs 5 do not run parallel to the center axis (=line of sight), but instead their orientation is optimized to the intake conditions. The webs may advantageously also have a curvature to guide the flow optimally. For example, a web 29 that is an axially aligned web is marked, i.e., it runs parallel to the axis (line of sight and sliding direction), which facilitates mold release. Axially aligned webs 29 are advantageously provided with a mold release angle. However, there are also webs 30, 30*a* that are not aligned axially, because all the webs 5 are optimized to the directions of flow. The two radially outermost rows of grid webs 5, running approximately circumferentially, are situated in the transitional area 24 of the enveloping surfaces 7 or 8 and are coordinated so as to result in only a few undercut areas or none at all, i.e., they conceal one another only slightly or not at all, as seen in the axial direction. In the embodiment shown here, for example, there is a small undercut area 17 in the combination of the web 5*a* of the radially outermost row of webs 5 and of the web 5*b* of the second row of webs 5, because these two webs have a slight overlap area in the line of sight. When a suitable, relatively elastic material is chosen, minor undercuts can be produced, while nevertheless allowing unmolding of parts in the axial direction using a simple open-and-close mold. This makes it possible to easily and economically produce a contour that is highly optimized fluidically. In addition, there is a minor undercut area in the branching area branching area 15 between the two webs 30 and 30*a* that are not aligned axially, because the x-components of their surface normal vectors have different plus or minus signs. This minor undercut can also be removed easily from a simple open-and-close mold if a suitable material is chosen.

In this embodiment, the cells in the area near the axis are smaller than those in an area remote from the axis. The cell size, i.e., cell width w (12, see FIG. 2), is optimized with regard to the requirements about compliance with contact protection regulations and acoustic improvements and/or flow smoothing measures. The distribution of cells is optimized by using an algorithm. There are a wide variety of cell contours (looking at one of the enveloping surfaces 7 or 8), for example, regular and irregular rectangles, pentagons and hexagons. Each cell (looking at an enveloping surface 7 or 8) describes approximately an area of points that are closest to an imaginary central point (on the enveloping surface) in comparison with the imaginary central points of all other cells. Consequently, the structure of grid 1 of this example includes exactly three webs 5 in most branching areas 15, and four webs 5 converge in far fewer branching areas. Furthermore, there are no relatively small cells at the border with a flow-through area of less than 50% with respect to the flow-through area of one of the neighboring cells that are formed by an effect of "cutting through outer cells at the border."

According to FIG. 4, the intake grid 1 from FIGS. 1 to 3 is shown in an axial top view from the rear (as seen from the outflow side). The webs 35 of the outer row that are aligned in the axial direction have one free end 14. Therefore, they can be unmolded by a mold slide valve moving in the direction of the outflow side (toward the observer) when opening. The fact that the ends 14 of the outer webs 35 are not connected is a disadvantage with respect to strength and dimensional stability, but this can be compensated by a high-quality material or by thick walls d (10).

The intake grid 1 in this embodiment includes four identical segments. This is an advantage in construction of the part and the mold required for production, because the number of differently shaped grid cells 6 is thereby reduced by a factor of 4 (factor=number of segments). Due to this segmentation, the flow pattern is independent of the alignment x (quadrant) of the intake grid 1 in assembly. A different number of segments is also possible. The segments may differ in minor ways, for example, with regard to mounting measures, if the number of mounting measures does not correspond to the number of segments, or in an inner area near the axis, where segmentation may be more difficult under some circumstances. In a case of large outside diameters, segmentation can be used advantageously, so that the intake grid 1 can be assembled from a plurality of injection-molded segments, for example, by clipping, snapping, screwing, gluing, fastening to the nozzle plate or the like. With this multi-part approach, it is also conceivable to produce a different separate central part in addition to the actual identical segments, although this different part then requires a separate injection mold. However, the central part may have a simple design, for example, being planar, i.e., flat.

In the embodiment shown here, there is a central branching point 16 of four (=number of segments in the embodiment) webs 5 at the center, on the axis.

FIG. 5 shows the intake grid 1 according to FIGS. 1 to 4 in a side view and in a sectional view of a plane through the axis. The shape of the cage-type contour of the enveloping surfaces 7 on the inflow side and/or enveloping surfaces 8 on the outflow side can be seen well here. The outer enveloping surface 7 has an outside diameter D (20), which is also referred to as the diameter D (20) of the intake grid 1, but the diameter of the mounting areas 18 is not taken into account here. The outer enveloping surface 7 and the inner enveloping surface 8 run approximately parallel to one another in this embodiment. The distance of the enveloping surfaces 7 and 8 from one another is advantageously 6 mm to 18 mm or approximately 3%-10% of the diameter D (20) of the intake grid 1. The contour runs for a distance approximately axially parallel (cylinder surface-type part 34) in the upper and lower areas near the mounting level. The transition to the flat area. 33 is continuous and curved in a transitional area 24, at the right in the diagram (inflow side). The transitional area 24 is short in the radial direction, amounting to less than 12.5% of the outside diameter D (20). The flat area 33 has a diameter DE (21), which is advantageously relatively large and amounts to at least 75°/h of the value of the outside diameter D (20). The intake grid 1 has an axial design height H (22), and the cylinder surface-type area on the outer enveloping surface 7 has an axial extent of HZ (23). HZ (23) is advantageously greater than 6% of the diameter D (20).

The cage-type contour of the intake grid 1 and/or its enveloping surfaces 7, 8 is/are well adjusted with regard to flow conditions. Air flowing in from the nozzle plate 32 in the radial direction is to be expected in the cylinder cage-type area 34; this can be achieved in short distances approximately across the enveloping surfaces 7, 8 and thus with minor flow losses due to the cylinder surface-type shape of the grid 1 in this area. An axial inflow is more to be expected in the flat, i.e., planar area 33, then also passing through the grid 1 for a short distance across the enveloping surfaces 7, 8. Due to the transitional area 24, which has a compact design and a small extent, a small design height H (22) can be achieved, which is advantageous for a small space requirement of the intake grid 1. The axial design height H (22) is advantageously no greater than 25% of D (20).

In addition, the targeted alignment of the webs can be seen well, not always running exactly perpendicular to the enveloping surface, but instead being configured to be deviating significantly from the exact inflow direction in some cases. In this embodiment, the webs 5 are not curved in the flow-through direction. However, this is quite conceivable with other embodiments. With the radially outer webs 35, the outer ends 14 are open, i.e., they are not connected to one another (except in the mounting areas 18).

FIG. 6 shows another embodiment of an intake grid 1, as seen in a perspective view from the front (from the inflow side). Unlike the embodiment according to FIGS. 1-5, the outer ends 14 of the webs 35 of the outer row are connected by an outer connecting ring 25. This increases the dimensional stability of the outer webs 35, which may be advantageous with regard to compliance with requirements for touchproof protection, for example, when using softer or more elastic materials. The outer connecting ring 25 may also be advantageous for the filling performance of an injection mold. The connecting ring 25 is connected to the webs 35 by means of an attachment 27. This attachment is configured as an extension area of the outer webs 35 in the form of a curvature with a large radius of curvature >3 mm. The mounting areas 18 are integrated into the connecting ring 25.

In this embodiment, the connecting ring 25 is in a plane representing the screw-on plane toward the nozzle 2 and/or the nozzle plate 32. In other advantageous embodiments, the connecting ring 25 may run with an axial offset from the screw-on plane, away from the mounting areas 35. This results in space between the nozzle 2 and the nozzle plate 32 and the connecting ring 25 in the mounted condition. The presence of such a space may be necessary for any screw heads that are present and may be used for screw connection of the nozzle 2 and the nozzle plate 32, or for positioning pressure unmolding devices. If the connecting ring runs with an axial offset from the screw-on plane in some areas, then some or all of the webs 35 of the outer row may protrude beyond them to the nozzle 2 and/or to the nozzle plate 32, or they may end at the connecting web 25, as seen in the axial direction. Additional webs may also be mounted in the area between the connecting web and the screw-on plane. In other embodiments, it is also conceivable for the connecting ring 25 to be interrupted in some areas and thus individual outer ribs 35 with open outer ends 14 may also be present. These outer ribs 35 with open outer ends 14 may also be shortened, so that the outer ends 14 are situated at a distance from the screw-on plane. This may also serve to create space for screw heads, pressure unmolding devices or the like between the screw-on plane and the intake grid 1 in the mounted condition.

FIG. 7 shows the intake grid 1 according to FIG. 6 in an axial top view from the rear (as seen from the outflow side). In this diagram, one can see that the connecting ring 25 is situated completely outside of all webs 5 radially, except for the axially aligned webs 35 of the outer row with their attachments 27 to the connecting ring 25. This is advantageous for easy mold release of the grid 1 from a simple open-and-close injection mold. FIG. 7 shows as an example four identical cells 26 of the grid 1 including four identical segments. Since the number of different cells is greatly reduced by such segmentation, this reduces the cost of construction of the grid 1 and the respective injection mold.

FIG. 8 shows an intake grid 1 in a perspective view as seen from the front (from the inflow side). The cells 6 and the webs 5 there are not arranged in a honeycomb nor is the arrangement unstructured. Instead there are webs 5 running radially and over the circumference. Four webs 5 running radially meet at a central branching point 16 in the central axial area. The number of webs 5 that meet in each branching area 15 is usually four. The intake grid 1 has a cage-type contour of the outer enveloping surface 7. In this embodiment, there is no transitional area formed between the flat area 33 and the cylinder surface-type area 34, but instead there is a "kink" separating or connecting these two areas. A design similar to that according to FIG. 8 with a steady tangential transitional area 24, resembling that of the embodiment according to FIGS. 1-5, is conceivable. The mounting areas 18 in the Intake grid 1 according to FIG. 8 are attached between two neighboring webs 35 of the outer row of the grid 1, as seen in the circumferential direction.

The webs 5*a* and 5*b*, which are shown as examples, have a large undercut area 17 with respect to a direction of mold release parallel to the axis. Because of this large undercut area, mold release from a simple open-and-close injection mold, parallel to the axial direction, is not conceivable. It is conceivable to have mold release with slide valves that yield mold release radially outward in a star pattern, forming the part of the grid 1 that corresponds to the cylinder surface-type part 34.

FIG. 9 shows the intake grid 1 according to FIG. 8 in a perspective view from the rear (as seen from the outflow side). The cage-type contour of the inner enveloping surface 8 can be seen well here.

FIG. 10 shows the intake grid 1 according to FIGS. 8 and 9 in an axial top view from the front (as seen from the inflow side). Four identical cells 26 of the four-part segmentation are shown as examples.

FIG. 11 shows the intake grid 1 according to FIGS. 8 to 10 in a side view and in a sectional view of a plane through the axis. With this grid 1, the diameter D (20) of the grid 1 corresponds to the diameter DE (21) of the flat, i.e., planar area 33, because no transitional area is formed. The axial design height H (22) of the grid 1 is slightly larger than the axial height HZ (23) of the cylindrical part, because the mounting areas 18 protrude to the right axially beyond the grid (toward the screw-on plane). This means that in the mounted condition, there is a small distance between the nozzle 2 and/or the nozzle plate 32 and the grid 1 and/or the webs 35 of the outer row beyond the mounting areas. This distance offers space for the screw heads of screws connecting the nozzle 2 and the nozzle plate 32, for example, or space for pressure unmolding devices in the radius of the inlet nozzle 2. A similar design, wherein space is formed between at least a few outer grid webs 35 and/or also an outer connecting ring 25 and the nozzle 2 and/or the nozzle plate 32, is also conceivable for embodiments having unstructured grids similar to those in FIGS. 1 to 7 and 12 to 16. Likewise, in embodiments having unstructured grids, it is also conceivable for no transitional areas to be formed between the cylinder surface-shaped area 34 and the flat, i.e., planar area 33 of the intake grid, but instead they abut against one another at a kink.

FIG. 12 shows another embodiment of an intake grid 1 in a side view and in a sectional view of a plane through the axis. The webs 5 in this embodiment are partially curved, as seen in the sectional view. Therefore, an even better configuration of the grid 1 and/or the webs 5 to the incoming flow can be achieved. Furthermore, advantages can be achieved in mold release with fixed surface angles of the webs 5 on the inflow side (outer enveloping surface 7) that are more favorable for flow. In addition, a targeted, low-loss deflection of the inflow can be achieved as needed with the help of curved webs 5. Any curvatures (direction, amount) are conceivable. Curved webs 5 may also be axially aligned webs at the same time. In this way, webs 35 of the outer row, for example, may also be curved and aligned axially.

FIG. 13 shows another embodiment of an intake grid 1 in a perspective view from the front (from the inflow side). The grid 1 has an unstructured arrangement, so that three webs 5 meet at the branching areas 15 in most cases. An outer connecting ring 25 by means of which the webs 35 of the outer row are connected to one another is formed. The attachments 27 of the outer webs 35 to the connecting ring 27 are configured as rounded forms with relatively large radii of curvature in extension of the webs themselves. The attachments 27 advantageously extend over a large portion of the radial extent of the connecting ring 25 (over more than half of this area) as seen in the radial direction. Four mounting areas 18 are integrated into the shape of the connecting ring 25. The outer webs 35*b*, which are situated approximately centrally in the mounting areas 18, as seen in the circumferential direction, have a reduced outside diameter in order to gain access to the screw connection of the intake grid to the mounting areas 18. These outer webs 35*h*, which have a reduced outside diameter, are advantageously extended inward, to achieve the required stability and the required cross section for the injection molding process (see also the web 35*b* of the outer row in the area of a mounting area 18 in FIG. 16).

In the embodiment according to FIG. 13, a closed central injection area 28 is provided. In injection molding of plastics, the molten plastic is injected centrally in this injection area 28 and is then distributed into the webs 5 via this disk-shaped area. In this embodiment, the innermost webs 5 have an inner end 31, where they are attached to the central injection area 28.

FIG. 14 shows the intake grid 1 according to FIG. 13 in an axial top view from the front (as seen from the inflow side). This embodiment is configured without any undercuts at all with respect to mold release in the axial direction. This greatly facilitates the production of molds and ensures a reliable injection molding process with short cycle times. As an example, this shows two webs 5*a* and 5*b*, whose positions are coordinated so that they do not overlap, as seen in this axial top view. To achieve this, it is important to have a close coordination of the shape of the enveloping surfaces 7 and 8, the choice of web depths t (9), and the position and alignment of webs, taking into account compliance with regulations requiring touchproof measures.

To prevent undercut areas close to the branching areas 15, when using axially aligned webs 29, it is important to prevent two webs 30 that are not aligned axially from meeting at a branching area 15, such that vectors normal to the wall and aligned toward the same cell 6 have x components (axially parallel components) with different plus and minus signs. Consequently, in this embodiment with a branching area 15, two webs 30 that are not aligned axially often meet at one axially aligned web 29, or three axially aligned webs 29. Other combinations occur less often. Axially aligned webs 29 are advantageously configured with mold release angles, to facilitate mold release from an injection mold. In an injection mold, both sides of an axially aligned web are formed by the same mold part. Strictly speaking, the property of being "axially aligned" applies to a central surface between the two sides of an axially aligned web 29.

To design a grid that is completely free of undercuts, limitations with regard to acoustics and efficiency must be accepted under some circumstances. Depending on the circumstances, it may also be advisable to accept minor undercuts, which can nevertheless allow unmolding with a simple mold (forced unmolding, rotational movement of mold parts, mapping of component contour areas on ejectors or the like).

In this embodiment, all the webs 5 are configured as axially aligned webs 29 in a radially inner area, approximately beyond a certain limit radius. Consequently, the mold may be configured so that no mold parting line runs obliquely through the cells in the case of the corresponding inner cells 6 with only or mainly axially aligned webs 29, but instead the complete contour of the cells can be introduced into a mold part. This further facilitates production of molds. This can be implemented well without any major loss of efficiency or acoustics because of the axial inflow in the inner area near the axis.

The embodiment according to FIG. 14 is constructed from twelve identical segments, wherein the 12-fold rotational symmetry through the only four mounting areas 18 is interrupted locally. The number of different cells 6 is definitely reduced by segmentation with a large number of segments. In this embodiment, the intake grid 1 has a total of 312 cells 6, but due to the segmentation, there are only 26 cells 6 of different designs. Embodiments with eight segments are also advantageous.

In the embodiment with four mounting areas 18, the number of segments is advantageously a multiple of 4. Segmentation can also be used to produce an intake grid 1, in multiple parts, with larger outside diameters.

FIG. 15 shows the embodiment according to FIGS. 13 and 14 in a side view. The attachment areas 27 of the outer webs 35 to the outer connecting ring 25 can be seen well. The attachment area 27, which is embodied here as a curvature, may also be embodied in some other form, for example, as a chamfer.

FIG. 16 shows the embodiment according to FIGS. 13 to 15 in a side view and in a sectional view of a plane through the axis. The webs 5*a* and 5*b* described as examples do not overlap, as seen in the axial direction. In addition, the connecting ring 25 does not conceal the web 5*a*, as seen in the axial direction. All of this is advantageous for a simple design of the injection mold, because undercuts between the webs 5*a* and 5*b* and the connecting ring 25 are to be avoided with regard to mold release parallel to the axial direction. For better accessibility, the webs 35*b* of the outer row, which are in the area of the mounting areas 18, are adapted to the screws with which the intake grid 1 is screwed onto an inlet nozzle 2 or onto a nozzle plate 32, and their outside diameter is reduced. To have a web depth t there that is favorable for the strength and the injection molding process, these webs 35*b* also have at least a slight inward offset in the diameter.

The central injection area 28 can be seen well in the sectional view. In the injection molding process, the molten plastic injected centrally in this area can be distributed well to the webs 5 through the inner ends 31. The inner ends 31 here advantageously have a curvature with the central injection area 28 and/or they are provided with a chamfer.

FIG. 17 shows as an example a fan with an intake grid 1, a nozzle 2, which is mounted on a nozzle plate 32, and a fan impeller 3, which is driven by a motor, as shown schematically. During operation, the air flows first through the intake grid 1 and into the inlet nozzle 2, before undergoing a total increase in pressure when flowing through the rotating impeller 3 of the fan. Turbulence in the inflow causes more noise to be generated in the fan. An intake grid 1 smooths out the inflow and thereby reduces the noise. Depending on the embodiment, the intake grid 1 also takes on the function of a touchproof measure on the intake side. The pressure drop occurring as air flows through the grid 1 is minimized by the advantageous design. This embodiment shows a diagonal fan 3. The intake grid 1 may be used equally well with a radial fan or an axial fan.

With regard to additional advantageous embodiments of the teaching, reference is made to the general part of the description and the accompanying claims in order to avoid repetition.

Finally, it should be pointed out explicitly that the examples of embodiments of the teaching as described above are presented merely to illustrate the claimed teaching, but the teaching is by no means limited to these embodiments.

LIST OF REFERENCE NUMERALS

1 Intake grid
2 Inlet nozzle
3 Fan impeller
4 Motor
5, 5*a*, 5*b* Web
6 Grid cell, flow channel
7 Outer enveloping surface on the inflow side
7*a* Outer end face of the webs on the inflow side
8 Inner enveloping surface
8*a* Inner end face of the webs on the outflow side
9 Web depth t
10 Web thickness d
11 Web length l
12 Cell width w, inner sphere radius
13 Neutral fiber of a web
14 Outer end of a web, border area
15 Branching area of webs
16 Central branching point of webs
17 Undercut area
18 Mounting area
19 Cell of the outer row
20 Diameter D of the grid
21 Diameter DE of the flat, i.e., planar grid part
22 axial height H of the grid
23 Axial height HZ of the cylinder surface-type part
24 Transitional area of the enveloping surface
25 Outer connecting ring
26 Identical cells of a segmentation
27 Attachment of the connecting ring
28 Closed, central injection area
29 Axially aligned web
30, 30*a* Web not axially aligned
31 Inner end of a web (border area)
32 Nozzle plate
33 Flat, i.e., planar area of the intake grid
34 Cylinder surface-type area of the intake grid
35 Web of the outer row
35*b* Web of the outer row in the area of a mounting area 18

The invention claimed is:

1. A fan, comprising:

an impeller; and a pre-directing device in the flow path upstream of an inlet region of an inlet nozzle, the pre-directing device being designed as an inlet grille with flat webs forming a multiplicity of cells with grid-like flow channels having a honeycomb-like cross-section, wherein the multiplicity of cells comprise a combination of irregular polygons with different cell contours wherein each polygon is one of a quadrilateral, a pentagon and a hexagon; and wherein the webs include axially aligned webs and axially not aligned webs, wherein in at least one branching area, two webs that are not aligned axially meet at least one axially aligned web.

2. The fan according to claim 1 wherein the cells in the region close to an axis of the impeller are formed smaller than those in the region remote from the axis.

3. The fan according to claim 1, wherein an area free of webs is formed in the center of the inlet grille.

4. The fan according to claim 1, wherein the webs have a web thickness in the range from 0.25 mm to 2 mm.

5. The fan according to claim 1, wherein a region of the contour close to an axis of the impellor is substantially flat orthogonal to the axis.

6. The fan according to claim 1, wherein an outer edge region of an inner contour of the inlet grill runs substantially parallel to an axis of the impellor.

7. The fan according to claim 1, wherein the inlet grille has, at an outer edge region integral to a portion of the webs, a fastening means configured to fasten the inlet grille to the inlet nozzle or a nozzle plate of the fan.

8. The fan according to claim 7, further comprising a stabilizing ring formed on the edge region of the inlet grille.

9. The fan according to claim 1, wherein the polygons have branches and nodes defined by the flat webs.

10. The fan according to claim 1, wherein a first portion of nodes have three webs and a second portion of the nodes have four webs.

11. A fan comprising:

an impeller; and a pre-directing device in the flow path upstream of the impeller the pre-directing device being designed as an inlet grille with flat webs forming a multiplicity of grid-like flow channels wherein the multiplicity of grid-like flow channels comprise a combination of irregular polygons with different cell contours wherein each polygon is one of a quadrilateral, a pentagon and a hexagon, wherein the inlet grill has a cylinder surface-type outer region and a flat central part, wherein the webs include axially aligned webs and axially not aligned webs, wherein in at least one branching area, two webs that are not aligned axially meet at least one axially aligned web.

12. The fan according to claim 11, wherein the polygons have branches and nodes defined by the flat webs.

13. The fan according to claim 12, wherein a first portion of nodes have three webs and a second portion of the nodes have four webs.

14. The fan according to claim 11, wherein an area free of webs is formed in the center of the inlet grille.

15. The fan according to claim 11, wherein the webs have a web thickness in the range from 0.25 mm to 2 mm.

16. The fan according to claim 11, wherein a region of a contour of the inlet grill close to an axis of the impellor is substantially flat orthogonal to the axis.

17. The fan according to claim 11, wherein an outer edge region of an inner contour of the inlet grill runs substantially parallel to an axis of the impellor.

18. The fan according to claim 11, wherein the inlet grille has, at an outer edge region integral to a portion of the webs, a fastening means configured to fasten the inlet grille to the inlet nozzle or a nozzle plate of the fan.

* * * * *